US009961995B2

(12) United States Patent
Kam

(10) Patent No.: US 9,961,995 B2
(45) Date of Patent: May 8, 2018

(54) SHELVING UNIT AND FIXING MEMBER FOR A SHELVING UNIT

(71) Applicant: Rankam (China) Manufacturing Co. Ltd., Hong Kong (CN)

(72) Inventor: Andy Ning Fan Kam, Hong Kong (CN)

(73) Assignee: Rankam (China) Manufacturing Co. Ltd., Hong Kong (CN)

( * ) Notice: Subject to any disclaimer, the term of this patent is extended or adjusted under 35 U.S.C. 154(b) by 0 days. days.

(21) Appl. No.: 14/865,352

(22) Filed: Sep. 25, 2015

(65) Prior Publication Data

US 2017/0086579 A1 Mar. 30, 2017

(51) Int. Cl.

| | |
|---|---|
| ***A47B 57/00*** | (2006.01) |
| ***A47B 57/50*** | (2006.01) |
| ***A47B 57/40*** | (2006.01) |
| ***A47B 57/48*** | (2006.01) |
| ***A47B 47/02*** | (2006.01) |
| ***A47B 57/44*** | (2006.01) |
| ***A47B 96/14*** | (2006.01) |
| *A47B 96/02* | (2006.01) |

(52) U.S. Cl.

CPC ..... *A47B 57/485* (2013.01); *A47B 47/028* (2013.01); *A47B 57/44* (2013.01); *A47B 96/1441* (2013.01); *A47B 47/02* (2013.01); *A47B 96/021* (2013.01)

(58) Field of Classification Search

CPC ... A47B 57/50; A47B 57/487; A47B 470/021; A47B 57/44; A47B 57/00; A47B 47/021; A47B 47/02; A47B 47/028; A47B 47/027; A47B 47/00

USPC ..... 211/191, 192

See application file for complete search history.

(56) References Cited

U.S. PATENT DOCUMENTS 3,251,478 A * 5/1966 Frazier ..... A47B 57/26 211/208
3,346,126 A * 10/1967 Bloom ..... A47B 57/487 211/192
3,392,848 A * 7/1968 McConnell ..... A47B 57/50 211/192
3,468,430 A * 9/1969 Lawman ..... A47F 5/14 211/182
3,472,393 A * 10/1969 Vetere ..... A47B 57/44 211/134
3,512,653 A * 5/1970 Erismann ..... A47B 57/50 211/192
3,545,626 A * 12/1970 Seiz ..... A47B 57/485 211/187
3,625,372 A * 12/1971 MacKenzie ..... A47B 57/402 211/191

(Continued)

*Primary Examiner* — Daniel J Troy
*Assistant Examiner* — Kimberley S Wright
(74) *Attorney, Agent, or Firm* — Leydig Voit and Mayer

(57) ABSTRACT

A backing plate for receiving a fastener to secure a horizontal support member to a vertical support member of a shelving unit. The horizontal support member is securable at any one of multiple vertical locations along the vertical support. The vertical support has a linear array of at least two evenly spaced apertures at the one of the vertical locations, and the backing plate has a corresponding linear array of at least two evenly spaced fixing points. At least one fixing point of the backing plate includes a projection for occupying a corresponding one of the apertures in the vertical support.

14 Claims, 20 Drawing Sheets

(56) References Cited

U.S. PATENT DOCUMENTS 3,626,487 A * 12/1971 Seiz ..... A47B 57/485 169/54
3,877,579 A * 4/1975 Weider ..... A47B 57/44 211/182
3,905,483 A * 9/1975 Patrick ..... A47F 5/10 211/190
3,905,712 A * 9/1975 McConnell ..... A47B 57/487 211/208
4,425,049 A * 1/1984 Travis ..... A47B 57/50 211/191
4,569,451 A * 2/1986 Parrott ..... E04B 1/58 211/182
4,807,947 A * 2/1989 Nuzzo ..... G09F 7/20 248/222.52
4,967,916 A * 11/1990 Handler ..... A47B 96/1416 108/188
5,012,938 A * 5/1991 King ..... A47B 47/027 211/182
5,025,937 A * 6/1991 King ..... A47B 57/22 211/192
5,350,074 A * 9/1994 Rosenband ..... A47B 47/021 211/191
5,411,154 A * 5/1995 Vargo ..... F16B 12/30 211/189
5,624,045 A * 4/1997 Highsmith ..... A47B 57/487 211/191
5,791,502 A * 8/1998 Bietz ..... A47B 57/50 211/192
6,230,910 B1 * 5/2001 Olsson ..... A47B 57/50 211/192
6,241,109 B1 * 6/2001 Kautz ..... A47B 57/50 211/192
6,510,955 B2 * 1/2003 Pellegrino ..... F16B 7/0446 211/192
6,595,379 B1 * 7/2003 Powell ..... A47B 57/50 211/192
6,851,653 B2 * 2/2005 Crowley ..... A47B 96/028 211/192
6,926,378 B2 * 8/2005 Greenwald ..... A47B 88/43 312/223.1
7,255,409 B2 * 8/2007 Hu ..... A47B 88/43 211/26
7,762,411 B2 * 7/2010 Hilburn ..... A47B 88/044 211/192
8,302,788 B2 * 11/2012 Vargo ..... A47B 47/021 211/186
8,322,668 B2 * 12/2012 Tang ..... H05K 7/1489 211/175
8,596,731 B2 * 12/2013 Chen ..... H05K 7/1421 312/330.1
8,602,372 B2 * 12/2013 Yu ..... H05K 7/1489 211/192
8,672,150 B2 * 3/2014 Chen ..... A47B 57/50 108/147.16
8,695,816 B2 * 4/2014 Troyner ..... A47B 57/402 211/103
8,727,144 B2 * 5/2014 Krummell ..... B65G 1/02 211/191
8,876,426 B2 * 11/2014 Lanigan, Sr. ..... B60P 7/132 403/353
8,967,401 B2 * 3/2015 Wu ..... A47B 47/0083 211/191
2001/0045404 A1 * 11/2001 Pellegrino ..... F16B 7/0446 211/192
2002/0027116 A1 * 3/2002 Herzog ..... A47B 57/50 211/192
2004/0178309 A1 * 9/2004 Crowley ..... A47B 96/028 248/244
2012/0175477 A1 * 7/2012 Tang ..... H05K 7/1489 248/222.14
2013/0020452 A1 * 1/2013 Yu ..... H05K 7/1489 248/220.21

* cited by examiner

SHELVING UNIT AND FIXING MEMBER FOR A SHELVING UNIT

BACKGROUND INFORMATION

The present invention relates generally to so-called "knock-down" type shelving units that are shipped in a relatively compact form, and can be assembled by the user with selection of vertical height and distance between the shelf members.

SUMMARY OF THE INVENTION

According to a first aspect of the invention there is provided a shelving unit comprising a horizontal support member, a horizontal support member and a fastener for securing the horizontal support member to the horizontal support member, the horizontal support member being securable at any one of a plurality of vertical locations along the length of the vertical support, the vertical support having a linear array of at least two evenly spaced apertures at said vertical location, the shelving unit including a backing plate having a corresponding linear array of at least two evenly spaced fixing points wherein at least one fixing point includes a projection to occupy a corresponding one of the apertures, the horizontal support having a support flange with a fixing aperture, and a fastener that in use secure the fixing aperture.

Preferably, the vertical support has at least three evenly spaced apertures at said vertical location, the backing plate has a corresponding linear array of at least three evenly spaced fixing points wherein at least one fixing point includes a projection to occupy a corresponding one of the apertures, the horizontal support flange has two evenly spaced fixing apertures and bolts that in use secure the fixing apertures, apertures and fixing points not occupied by the projection.

Preferably, the projection remains in place during fixing of the horizontal and vertical supports.

According to a second aspect of the invention there is provided a backing plate for securing a horizontal member to a vertical member of a shelving unit, the backing plate having a linear array of at least three evenly spaced fixing points wherein at least one fixing point includes a projection to occupy an aperture in one of the horizontal member or vertical member.

Further aspect of the invention will be come apparent from the following description which is given by way of example only to illustrate the invention.

DESCRIPTION OF EMBODIMENTS OF THE INVENTION

The following description is given by way of example only to illustrate the invention and is not intended to limit the scope of use of functionality of the invention. In particular, the invention is not limited in its application to the exact details of construction and the arrangements of elements set forth in the following description or illustrated in the accompanying drawings. A skilled person will appreciate that the invention is capable of being practiced in other embodiments or carried out in various other ways.

Figure 1:
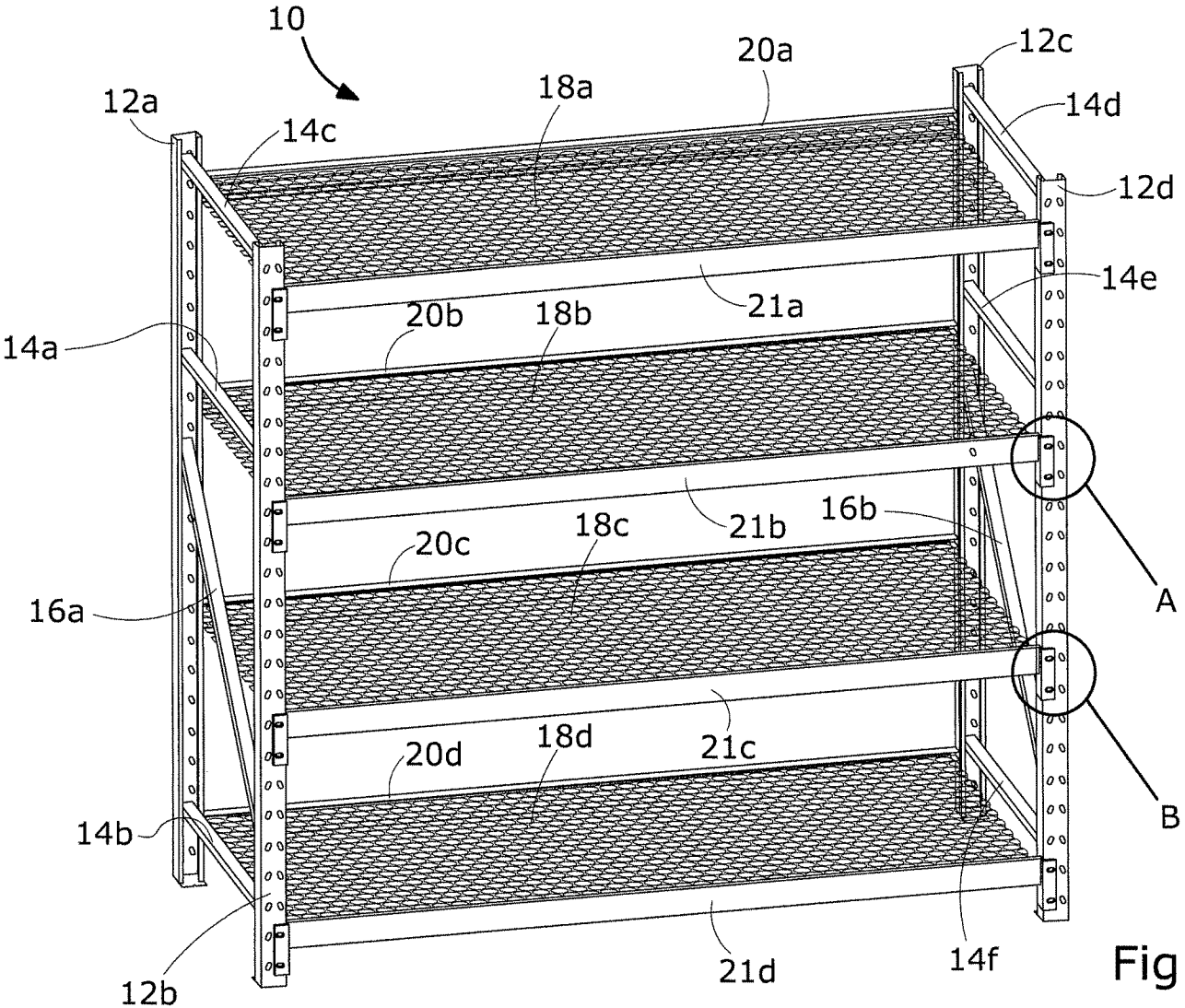
FIG. 1 is a frontal perspective view of a shelving unit.

In FIG. 1 there is shown by way of example a typical shelving unit assembled according to embodiments of the present invention. Such a shelving unit has a modular construction consisting of at least four vertical corner support members 12*a-d* although more vertical supports may be provided depending on the size (e.g. length) and loading requirements of the shelving unit. At each end of the shelving unit respective pairs of front and back vertical corner support members 12*a-b* and 12*c-d* and connected by horizontal end support members 14*a-c* and 14*d-f* respectively forming end modules. The end modules are connected together by front and back horizontal support members 21*a-d* and 20*a-d*. Respective pairs of front and back horizontal support members, for example 20*a*-21*a*, 20*b*-21*b*, 20*c*-21*c* and 20*d*-21*d*, are spaced vertically to support between each vertically spaced pair 20*a*-21*a*, 20*b*-21*b*, 20*c*-21*c* and 20*d*-21*d* a respective shelf 18*a*, 18*b*, 18*c* and 18*d*. The shelving unit may be braced by diagonal bracing members 16*a* and 16*b* as necessary. The present invention relates to such a shelving unit in which at least the vertical support members 12*a-b* and front and back horizontal support members 21*a-d* and 20*a-d* are made from folded, extruded, cast or similarly formed mild steel.

Respective pairs of front and back horizontal support members, for example 20*a*-21*a*, 20*b*-21*b*, 20*c*-21*c* and 20*d*-21*d*, are spaced vertically to support between each vertically spaced pair 20*a*-21*a*, 20*b*-21*b*, 20*c*-21*c* and 20*d*-21*d* a respective shelf 18*a*, 18*b*, 18*c* and 18*d*. The vertical corner support members 12*a-d* are folded, extruded, cast or similarly formed mild steel C-section (C-shaped) posts having a front face although the vertical corner support members 12*a-d* may have other section shapes such as I-section, T-section or X-section. The edges of the front face are drilled with a plurality of vertically spaced vertical-support apertures. The ends of the front and back horizontal support members 21*a-d* and 20*a-d* have respective flanges. The flanges are drilled with a pair of correspondingly spaced apart flanges apertures. The vertical height and distance between the shelf members 18*a-d* can be chosen during assembly of the shelving unit 10 by aligning the pairs of flanges apertures on each flange with any adjacent pair of the plurality of vertically spaced vertical-support apertures on a vertical corner support member 12*a-d* and securing the flange to the vertical corner support member 12*a-d* by passing a fastener through the aligned apertures and securing the fasteners to a movable fixing plate.

Figure 2:
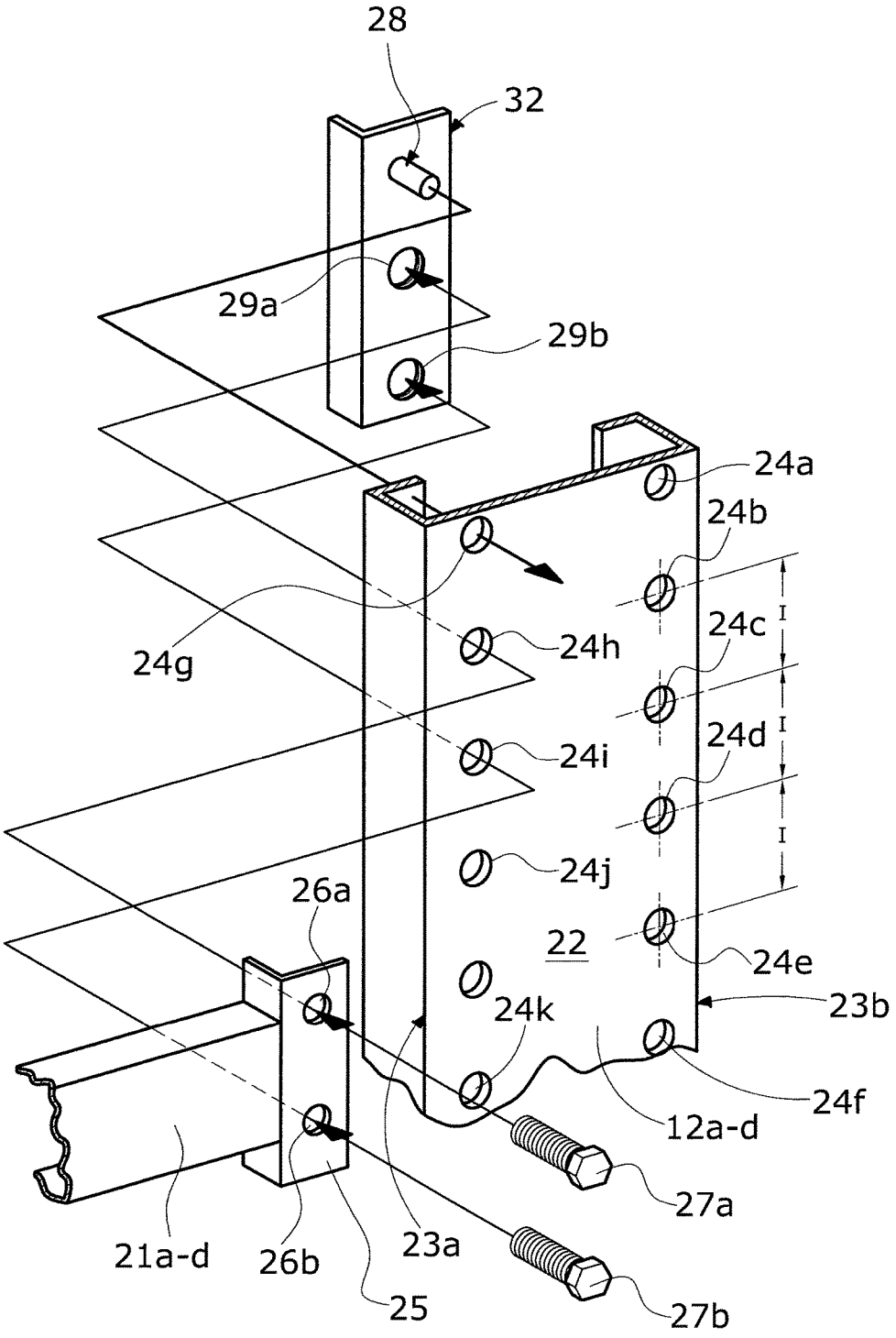
FIG. 2 is an exploded view of section A of FIG. 1 showing details of a first embodiment of a connection between a horizontal shelf support member and a vertical shelf support member.
Figure 3:
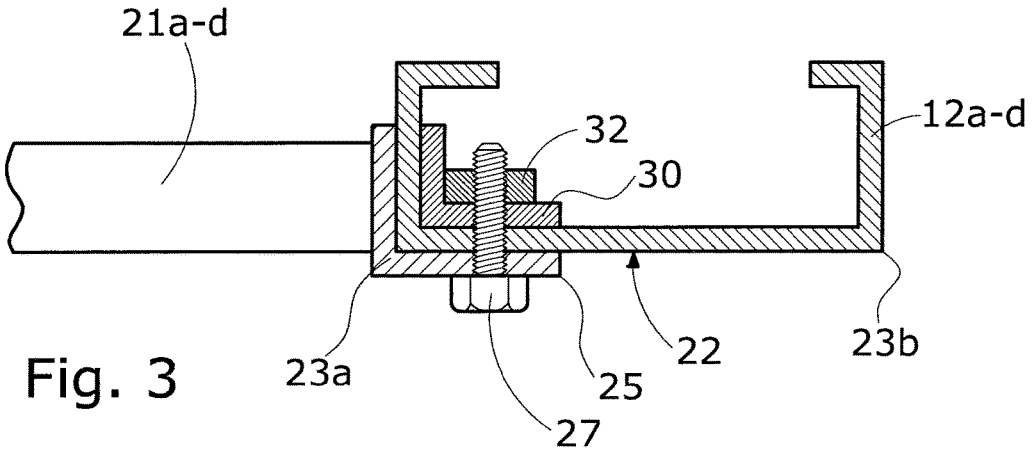
FIG. 3 is a top section view of the first connection between the horizontal shelf support member and the vertical shelf support member.
Figure 4:
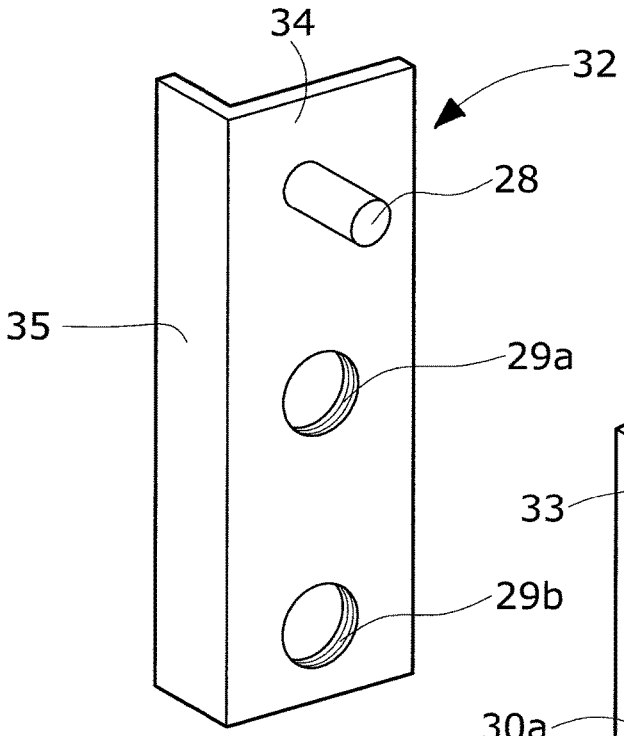
FIG. 4 is a frontal perspective view of a first embodiment of a fixing plate of the first connection between the horizontal shelf support member and the vertical shelf support member.
Figure 5:
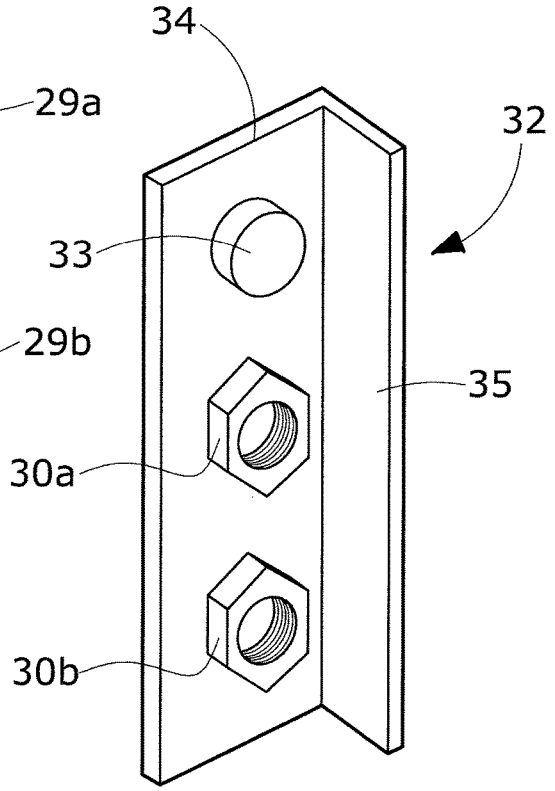
FIG. 5 is a rear perspective view of the fixing plate of FIG. 4.

FIGS. 2 through 5 shows a first embodiment of a connection between a horizontal shelf support member 20*a-d*, 21*a-d* and a vertical shelf support member 12*a-d*. The front face 22 of the substantially C-section vertical shelf support member 12*a-d* has a plurality of vertically spaced vertical-support apertures 24*a-f* drilled at vertical intervals I along at least one of its edges 23*a* or 23*b*. Preferable both edges 23*a* and 23*b* are so drilled with apertures for greater versatility and interchangeability of the vertical shelf support members 12*a-d*. In the illustration of FIG. 2 not all apertures are labelled 24 for clarity of the drawings. Preferably the vertical shelf support members 12*a-d* are drilled at intervals long the entire length of its front edges 23*a-b* for increased choice and utility, however in some embodiments a plurality of regions may be drilled with a plurality of apertures. In the preferred embodiment for example there may be only three evenly spaced apertures at each vertical location. The ends of the front and back horizontal support members 21*a-d* and 20*a-d* have respective flanges 25. The flanges 25 are drilled with a pair of correspondingly spaced apart flange apertures 26*a-b* such that the flanges apertures 26*a-b* may align with any two of the plurality of vertical-support apertures 24*a-f*.

During assembly of the shelving unit the vertical height and distance between the shelf members 18*a-d* can be chosen by aligning the pairs of flanges apertures with any adjacent pair of the plurality of vertically spaced vertical-support apertures. The horizontal support members 21*a-d* and 20*a-d* are secured to a vertical corner support member 12*a-d* by passing fasteners 27*a-b* through the aligned flange apertures 26*a-b* and chosen pair vertical-support apertures 24*h-i* and securing the fasteners to a movable fixing plate 32 which locates within the C-section of the vertical support member 12 behind the vertical-support apertures in the front face 22. The movable fixing plate 32 has a corresponding linear array of three evenly spaced fixing points 28 and 29*a-b*. One of the fixing points 28 includes a projection pin to occupy a vertical-support aperture 24*g* immediately above the chosen pair vertical-support apertures 24*h-i* aligned or to be aligned with the flange apertures 26*a-b*. The remaining two fixing points 29*a-b* comprises fixing apertures backed by threaded fixing nuts 30*a-b*. The threaded fixing nuts 30*a-b* are attached to the fixing plate 32 by welding or similar means. The fixing apertures 29*a-b* and corresponding threaded fixing nuts 30*a-b* align with the flange apertures 26*a-b* and chosen pair of vertical-support apertures 24*h-l* not occupied by the projection pin 28. Fasteners 27 pass through the aligned flange apertures 26*a-b* and chosen pair vertical-support apertures 24*h-i* and threadably secure with corresponding fixing nuts 30*a-b* of the movable fixing plate 32. The fixing plate 32 can advantageously be moved to any of the plurality of vertically spaced vertical-support apertures 24*a-f* to accommodate the choice of vertical height and distance between the shelf members 18*a-d* during assembly of the shelving unit 10.

The fixing plate 32 ameliorates any difficulty in securing the fasteners 27 by individual nuts which can be fiddly to start the thread and require two hands to secures and tighten. The projection pin holds the fixing plate in place during assembly of the shelving unit ameliorating the requirement for two hands to secure the fasteners 27. The movable fixing plate 32 also avoids the need and expense for a fixed nut for every one of the vertically spaced vertical-support apertures 24*a-f*. The projection remains in place after securing of the fasteners 27 fixing of the horizontal and vertical supports. In a first embodiment of FIGS. 4 and 5 the fixing plate 32 comprises a plate member 34 having the linear array of three evenly spaced fixing points 28 and 29*a-b*. Expending orthogonally from one edge of the plate member 34 is a side flange member 35 providing rigidity to the plate member 34. The projection pin 28 is a pin extending through an aperture in the plate member 34 and secured by a head 33 on the hack of the plate member 34. The flange apertures 26*a-b* are backed by threaded fixing nuts 30*a-b* attached to the plate member 34*by* welding or similar means. In other embodiments the flange apertures 26*a-b* may be internally threaded to avoid the need for fixing nuts 30*a-b*, or may be unthreaded apertures for accommodating self-tapping fasteners.

Figure 6:
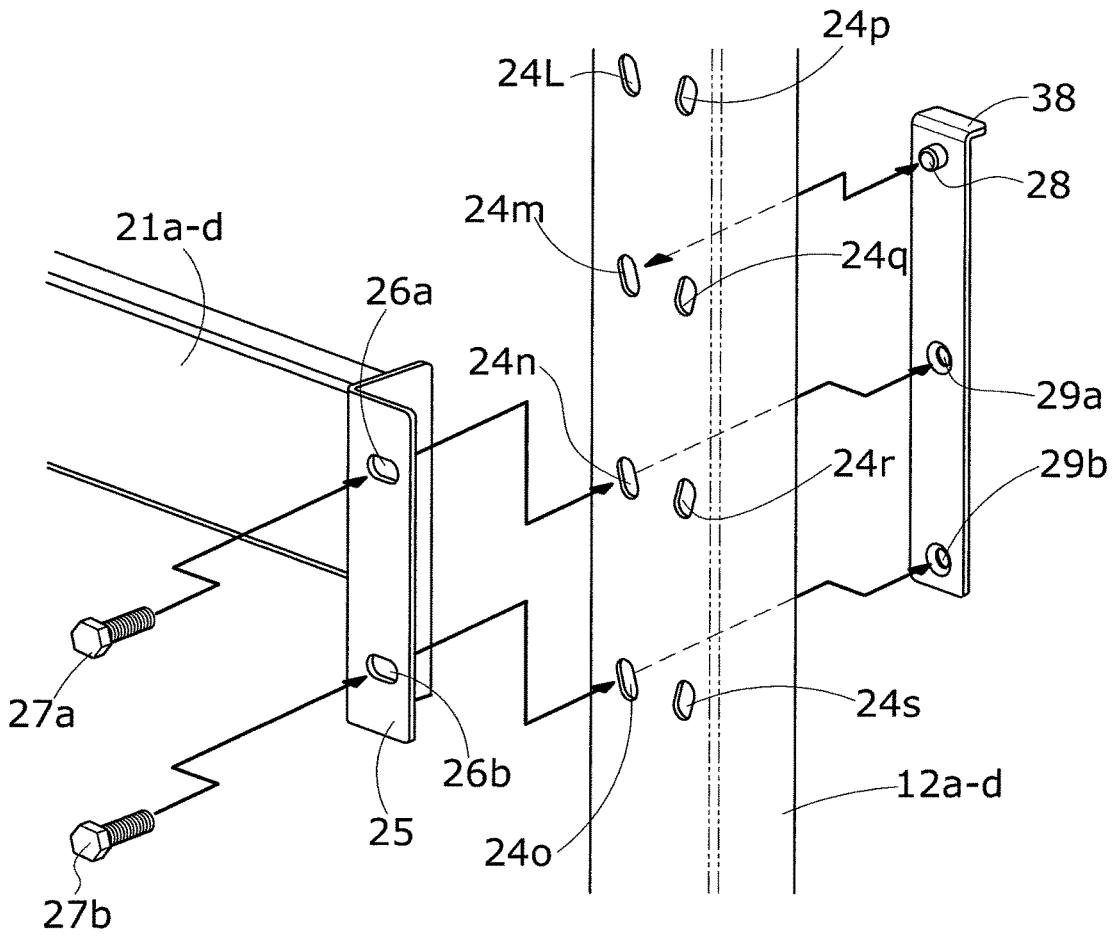
FIG. 6 is an exploded view of section B of FIG. 1 showing details of a second embodiment of a connection between a horizontal shelf support member and a vertical shelf support member.
Figure 7:
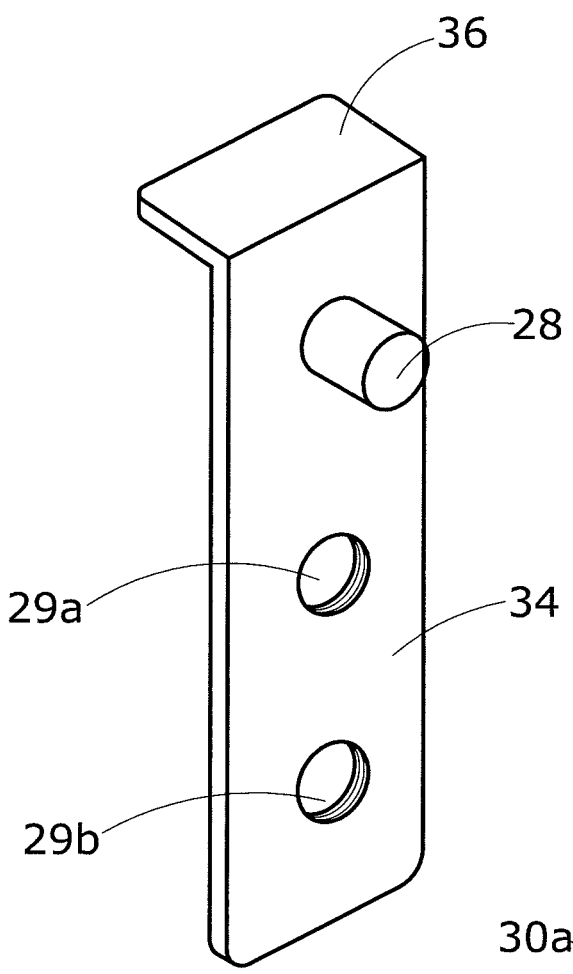
FIG. 7 is a frontal perspective view of a second embodiment of a fixing plate for the second connection between the horizontal shelf support member and the vertical shelf support member.
Figure 8:
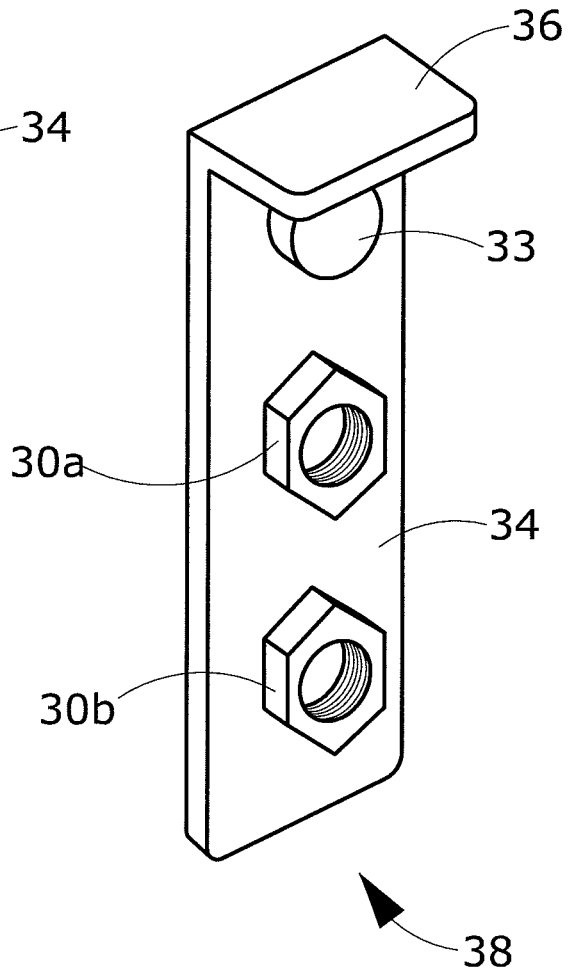
FIG. 8 is a rear perspective view of the fixing plate of FIG. 7.
Figure 9:
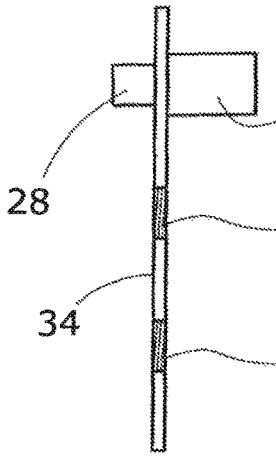
FIG. 9 is a side section view of a third embodiment of a fixing plate according to the invention.
Figure 10:
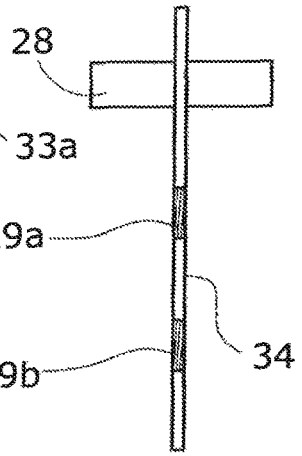
FIG. 10 is a side section view of a fourth embodiment of a fixing plate according to the invention.
Figure 11:
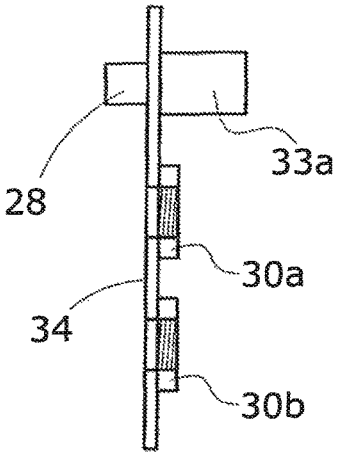
FIG. 11 is a side section view of a fifth embodiment of a fixing plate according to the invention.

FIGS. 6 through 8 show a second embodiment of a connection between a horizontal shelf support member 20*a-d*, 21*a-d* and a vertical shelf support member 12*a-d*. Elements bearing similar numbers to those elements described with reference to FIGS. 2 through 5 are like elements. The difference in the second embodiment is the fixing plate 38, which instead of a side flange member 35 providing rigidity to the plate member 34, the second fixing flange 38 has a top flange 36 extending orthogonally from a top edge of the plate member 34. All apertures in the first or second embodiments may also be oval or oblong to provide fit tolerances and aid alignment of the apertures. In some embodiments the fixing plate may have no side flange and may only have a single projection pin and single fastener fixing point as illustrated in FIGS. 9 to 17 and 35 to 97, in which broken lines are included for the purpose of illustrating environment and form no essential part of the third fixing plate.

Figure 12:
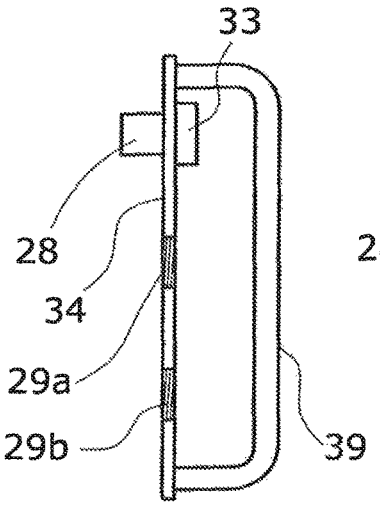
FIG. 12 is a side section view of a sixth embodiment of a fixing plate according to the invention.
Figure 13:
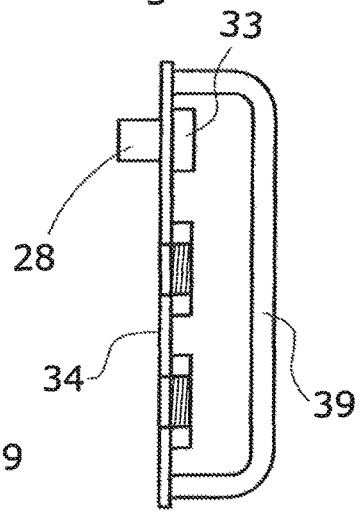
FIG. 13 is a side section view of a seventh embodiment of a fixing plate according to the invention.
Figure 14:
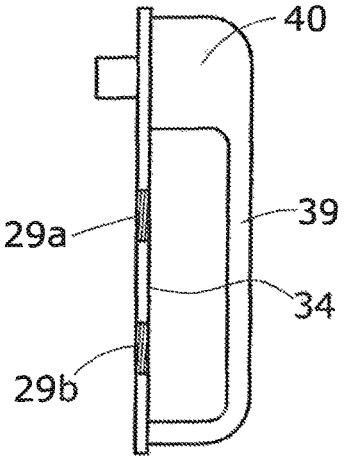
FIG. 14 is a side section view of a eighth embodiment of a fixing plate according to the invention.
Figure 15:
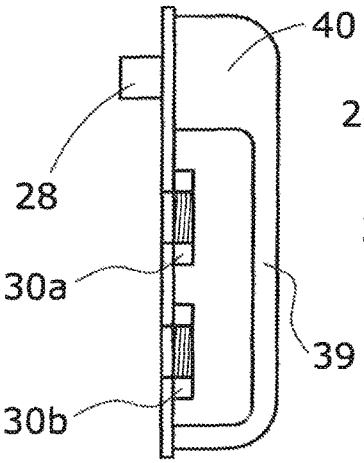
FIG. 15 is a side section view of a ninth embodiment of a fixing plate according to the invention.
Figure 16:
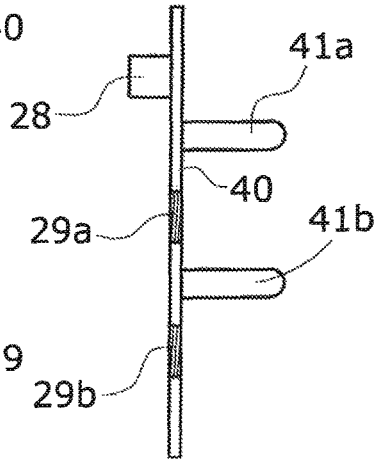
FIG. 16 is a side section view of a tenth embodiment of a fixing plate according to the invention.
Figure 17:
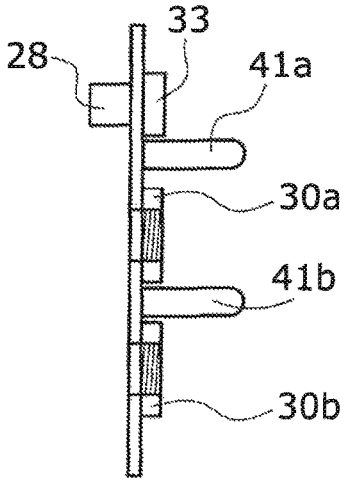
FIG. 17 is a side section view of an eleventh embodiment of a fixing plate according to the invention.
Figure 18:
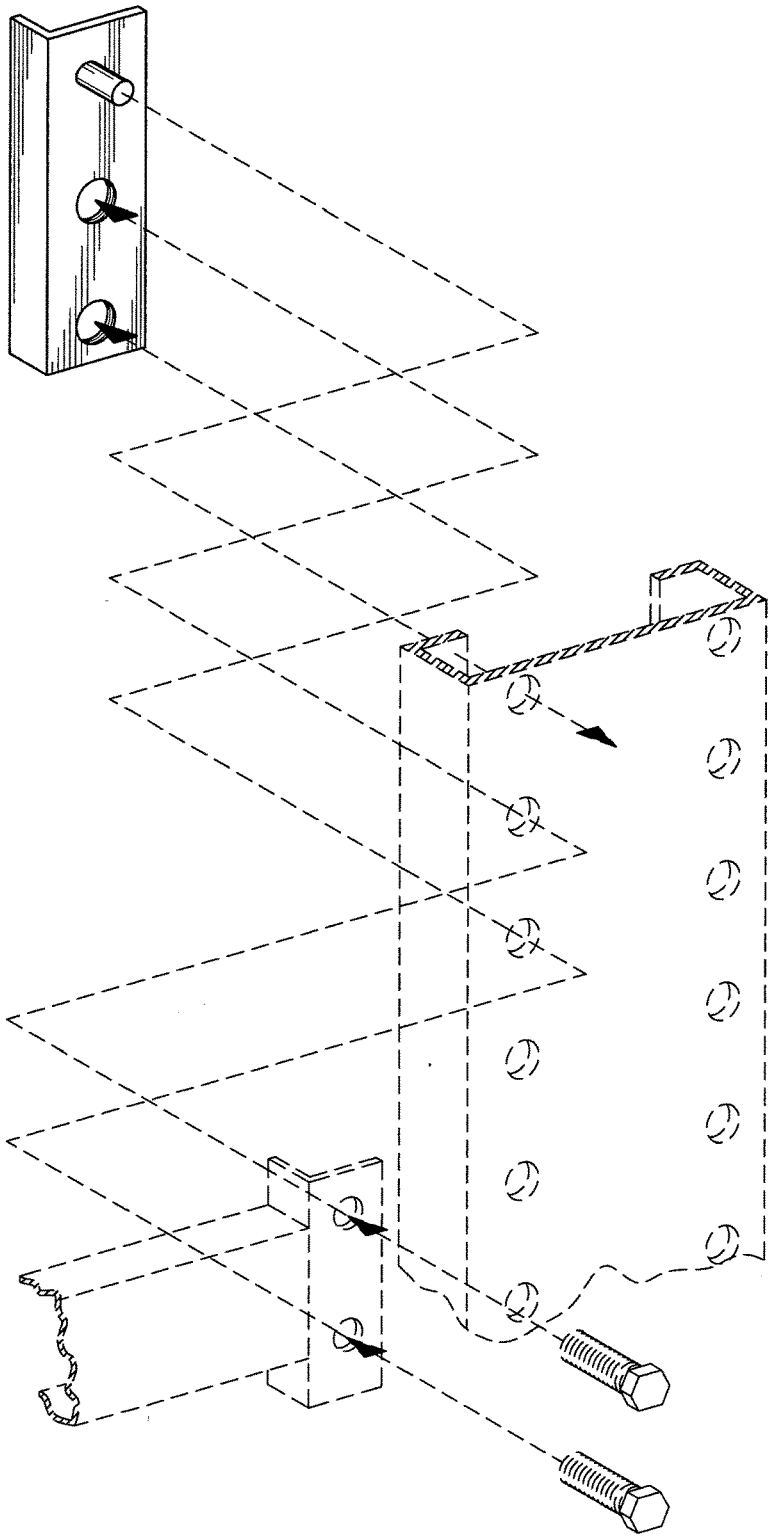
FIG. 18 is a frontal perspective view of the first fixing plate showing environmental conditions.
Figure 19:
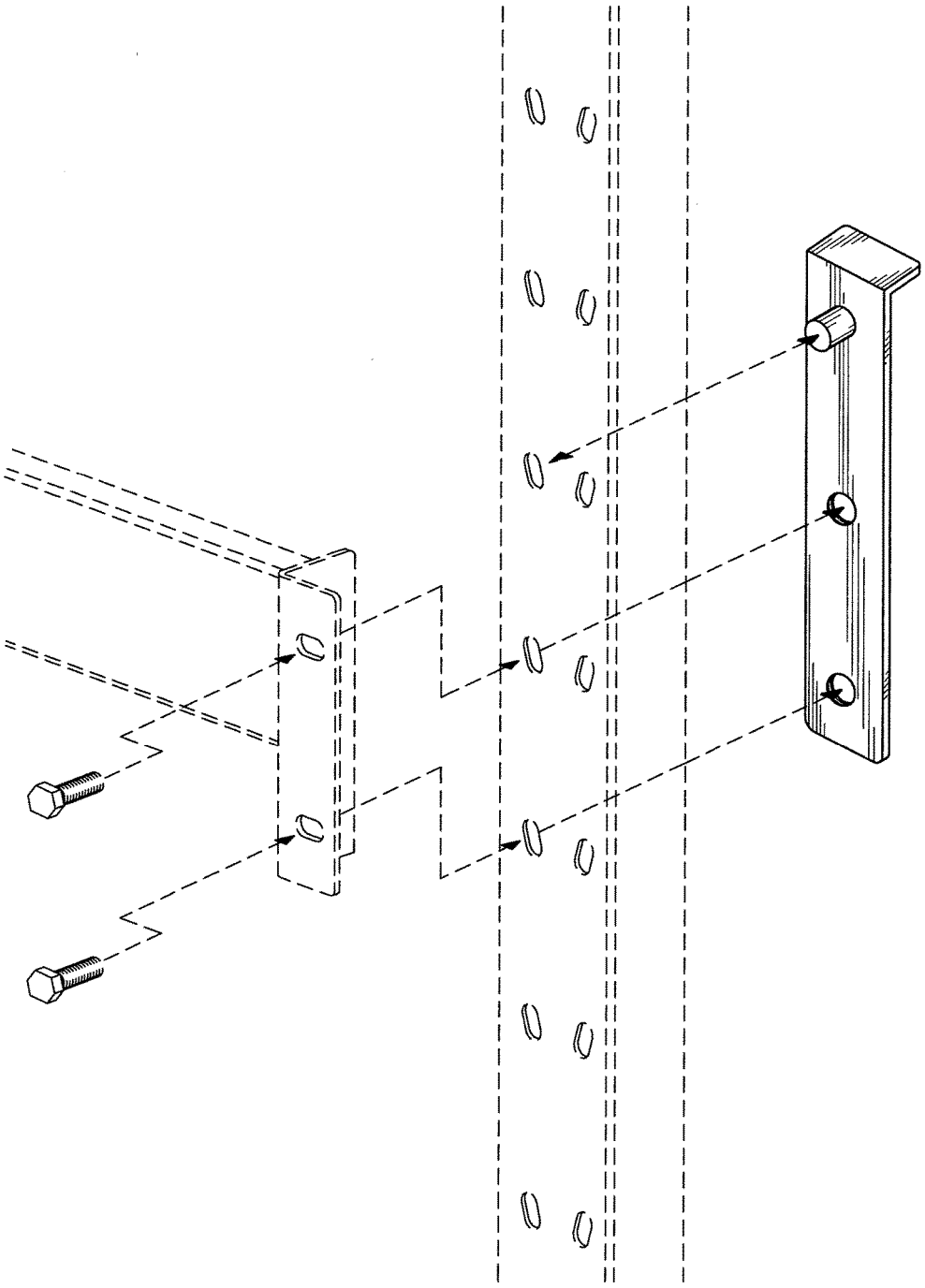
FIG. 19 is a frontal perspective view of the second fixing plate showing environmental conditions.
Figure 20:
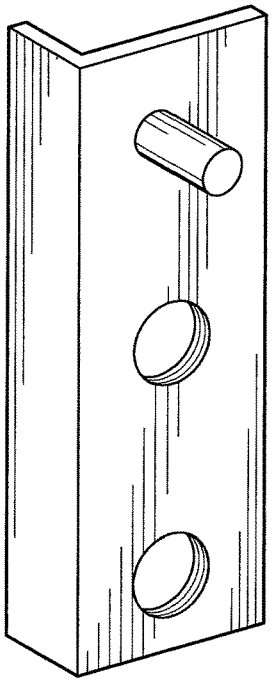
FIG. 20 is a frontal perspective view of the first fixing plate for a connection between a horizontal shelf support member and a vertical shelf support member.
Figure 21:
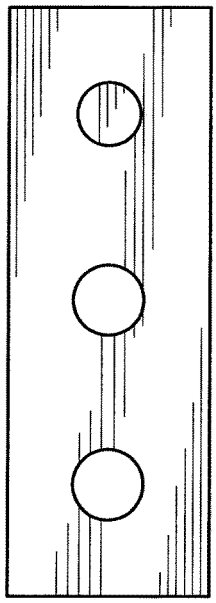
FIG. 21 is a rear perspective view of the fixing plate of FIG. 20.
Figure 22:
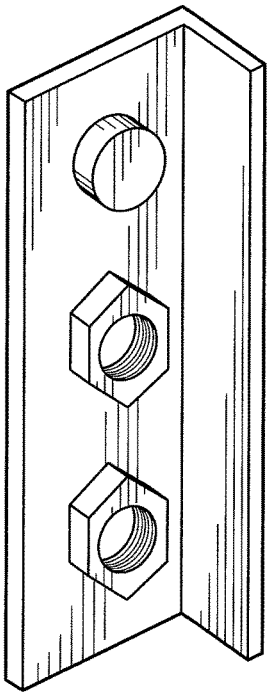
FIG. 22 is a front view of the fixing plate of FIG. 20.
Figure 23:
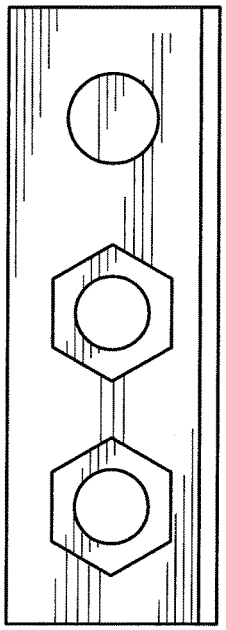
FIG. 23 is a rear view of the fixing plate of FIG. 20.
Figure 24:
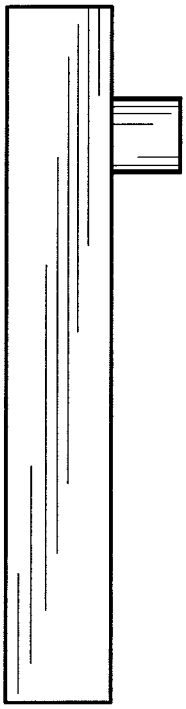
FIG. 24 is a first side view of the fixing plate of FIG. 20.
Figure 25:
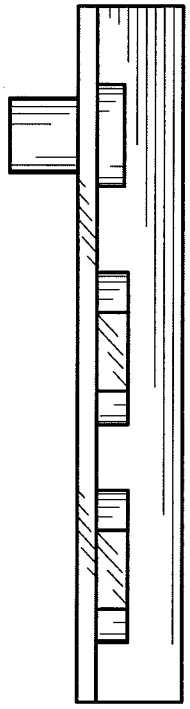
FIG. 25 is a second side view of the fixing plate of FIG. 20.
Figure 26:
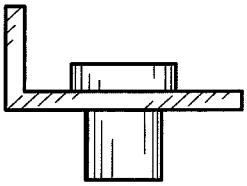
FIG. 26 is a top view of the fixing plate of FIG. 20.
Figure 27:
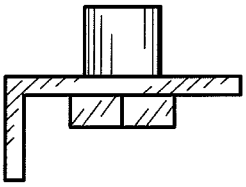
FIG. 27 is a bottom view of the fixing plate of FIG. 20.
Figure 28:
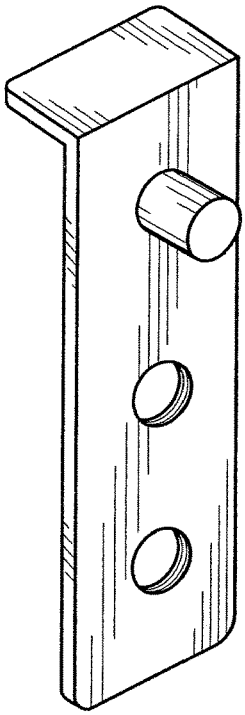
FIG. 28 is a frontal perspective view of the second fixing plate for a connection between a horizontal shelf support member and a vertical shelf support member.
Figure 30:
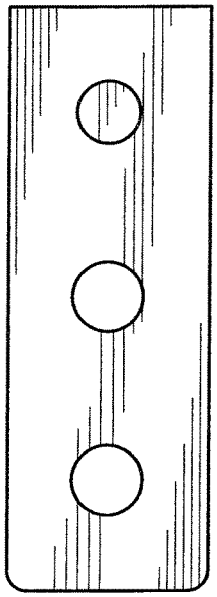
FIG. 30 is a front view of the fixing plate of FIG. 28.
Figure 33:
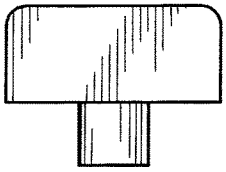
FIG. 33 is a top view of the fixing plate of FIG. 28.
Figure 32:
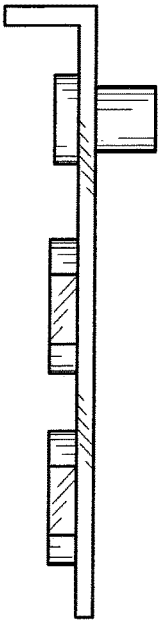
FIG. 32 is a first side view of the fixing plate of FIG. 28, the second side being a mirror image.
Figure 29:
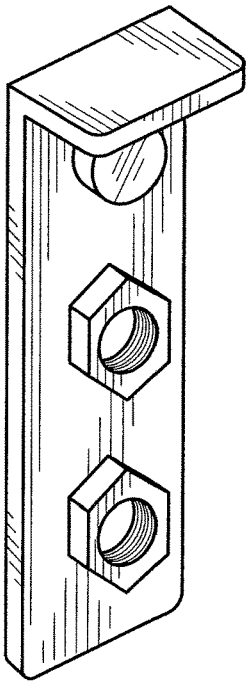
FIG. 29 is a rear perspective view of the fixing plate of FIG. 28.
Figure 31:
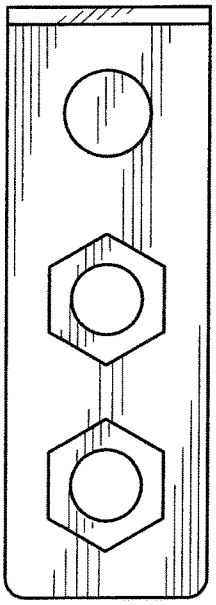
FIG. 31 is a rear view of the fixing plate of FIG. 28.
Figure 34:
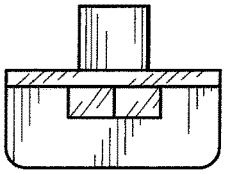
FIG. 34 is a bottom view of the fixing plate of FIG. 28.
Figure 35:
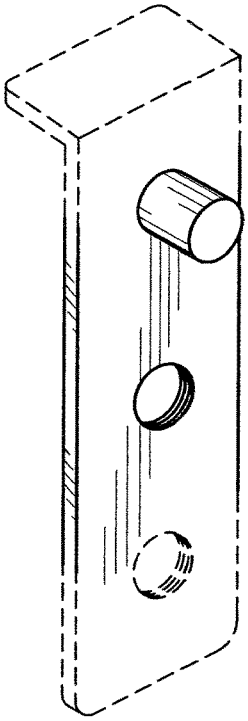
FIG. 35 is a frontal perspective view of a twelfth embodiment of a fixing plate, according to the invention, for a connection between a horizontal shelf support member and a vertical shelf support member.
Figure 37:
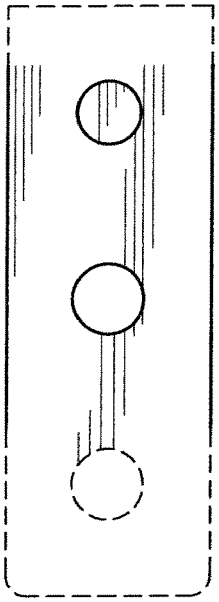
FIG. 37 is a front view of the fixing plate of FIG. 35.
Figure 40:
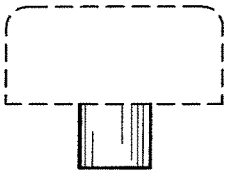
FIG. 40 is a top view of the fixing plate of FIG. 35.
Figure 39:
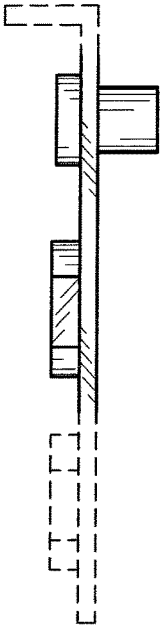
FIG. 39 is a first side view of the fixing plate of FIG. 35, the second side being a mirror image.
Figure 36:
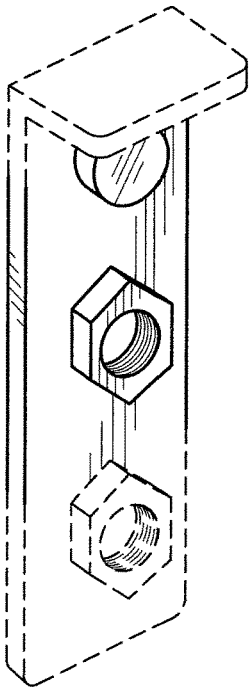
FIG. 36 is a rear perspective view of the fixing plate of FIG. 35.
Figure 38:
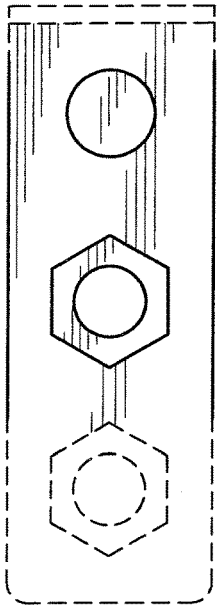
FIG. 38 is a rear view of the fixing plate of FIG. 35.
Figure 41:
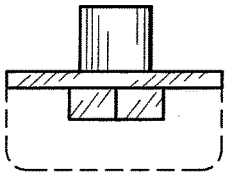
FIG. 41 is a bottom view of the fixing plate of FIG. 35.
Figure 42:
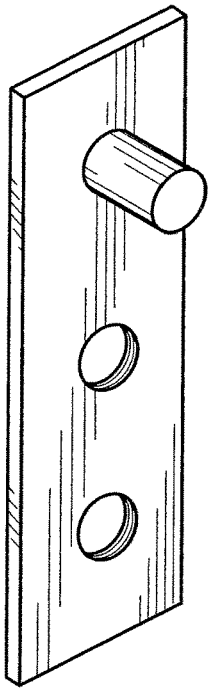
FIG. 42 is a rear perspective view of the third fixing plate, of FIG. 9, for a connection between a horizontal shelf support member and a vertical shelf support member.
Figure 43:
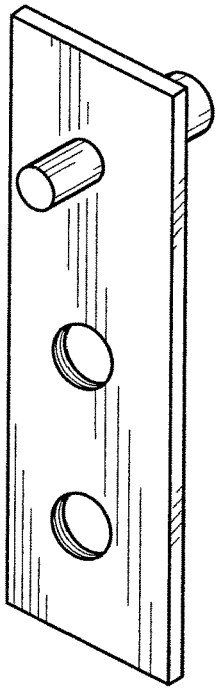
FIG. 43 is a front perspective view of the fixing plate of FIG. 42.
Figure 46:
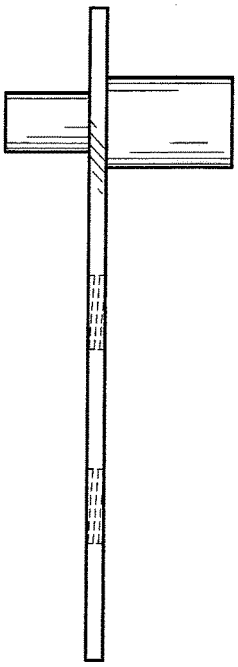
FIG. 46 is a first side view of the fixing plate of FIG. 42, the second side being a mirror image.
Figure 45:
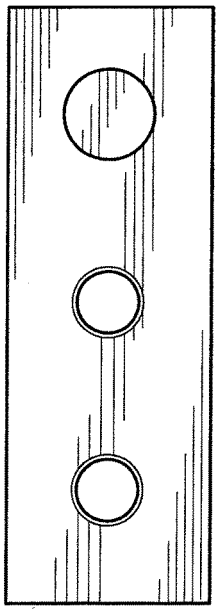
FIG. 45 is a rear view of the fixing plate of FIG. 42.
Figure 44:
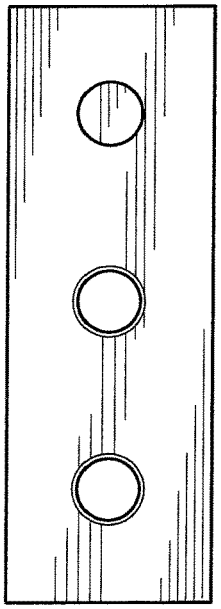
FIG. 44 is a front view of the fixing plate of FIG. 42.
Figure 47:
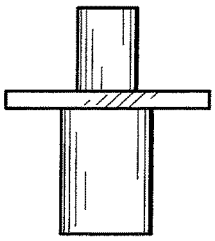
FIG. 47 is a top view of the fixing plate of FIG. 42.
Figure 48:
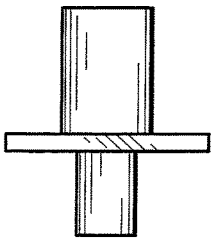
FIG. 48 is a bottom view of the fixing plate of FIG. 42.
Figure 49:
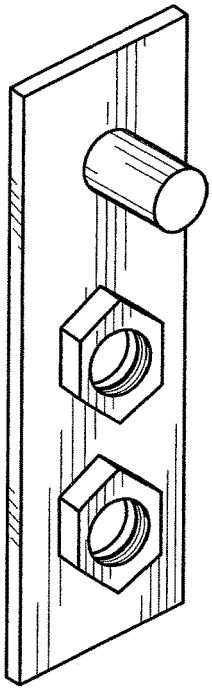
FIG. 49 is a rear perspective view of the fifth fixing plate, of FIG. 11, for a connection between a horizontal shelf support member and a vertical shelf support member.
Figure 50:
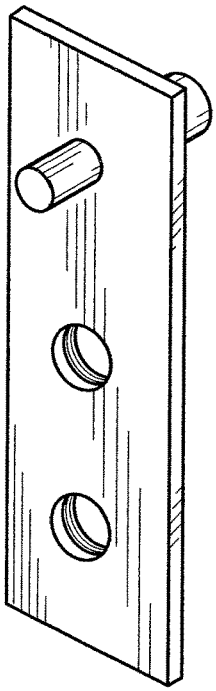
FIG. 50 is a front perspective view of the fixing plate of FIG. 49.
Figure 53:
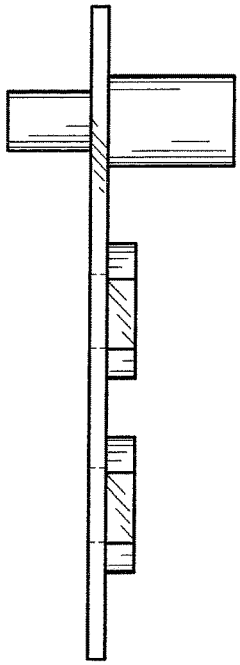
FIG. 53 is a first side view of the fixing plate of FIG. 49, the second side being a mirror image.
Figure 52:
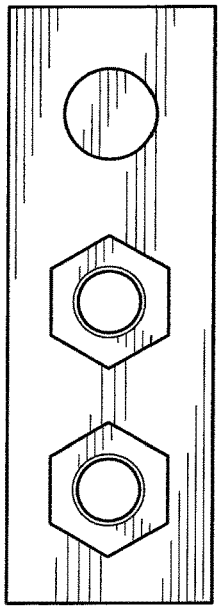
FIG. 52 is a rear view of the fixing plate of FIG. 49.
Figure 51:
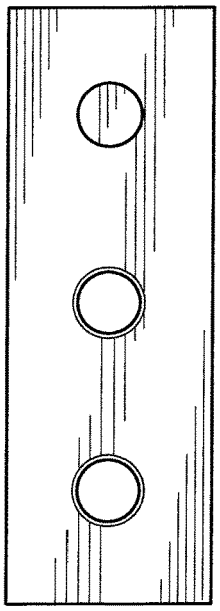
FIG. 51 is a front view of the fixing plate of FIG. 49.
Figure 54:
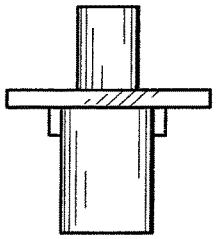
FIG. 54 is a top view of the fixing plate of FIG. 49.
Figure 55:
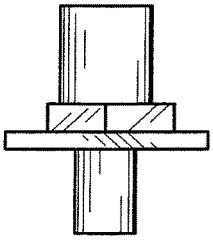
FIG. 55 is a bottom view of the fixing plate of FIG. 49.
Figure 56:
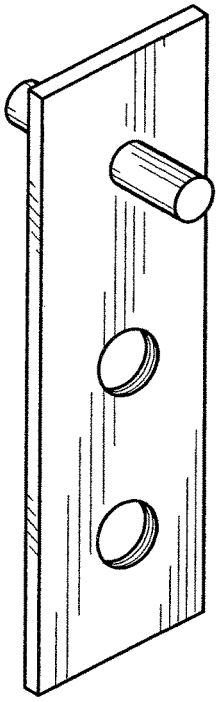
FIG. 56 is a frontal perspective view of the fourth fixing plate, of FIG. 10, for a connection between a horizontal shelf support member and a vertical shelf support member.
Figure 57:
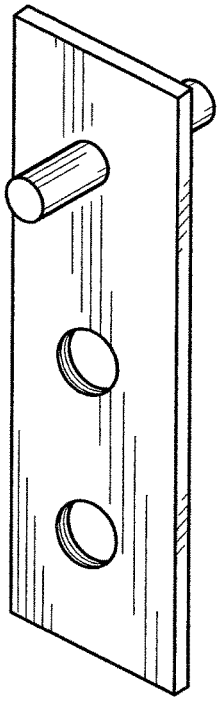
FIG. 57 is a rear perspective view of the fixing plate of FIG. 56.
Figure 60:
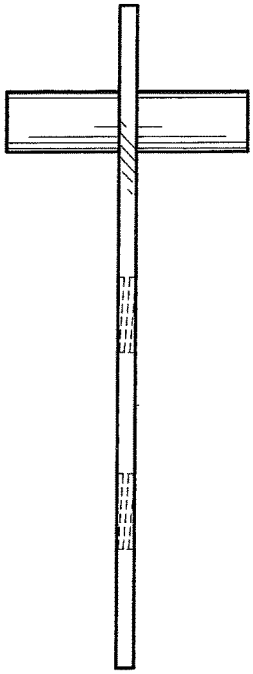
FIG. 60 is a first side view of the fixing plate of FIG. 56, the second side being a mirror image.
Figure 59:
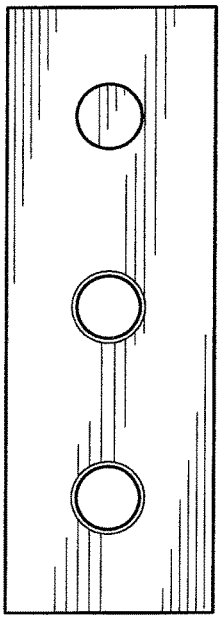
FIG. 59 is a rear view of the fixing plate of FIG. 56.
Figure 58:
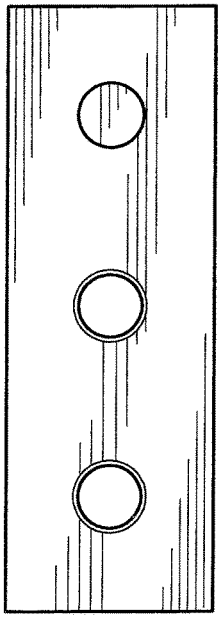
FIG. 58 is a front view of the fixing plate of FIG. 56.
Figure 61:
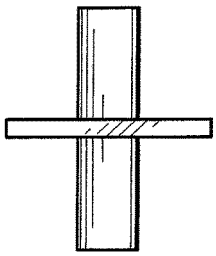
FIG. 61 is a top view of the fixing plate of FIG. 56.
Figure 62:
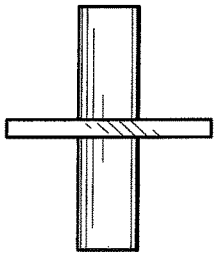
FIG. 62 is a bottom view of the fixing plate of FIG. 56.
Figure 63:
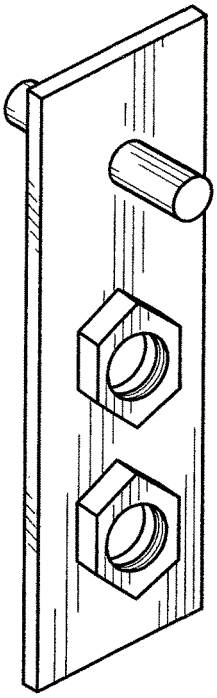
FIG. 63 is a rear perspective view of the thirteenth embodiment of a fixing plate for a connection between a horizontal shelf support member and a vertical shelf support member.
Figure 64:
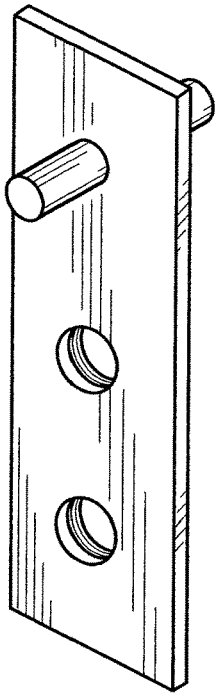
FIG. 64 is a front perspective view of the fixing plate of FIG. 63.
Figure 67:
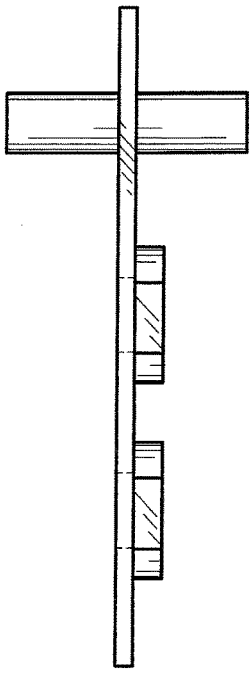
FIG. 67 is a first side view of the fixing plate of FIG. 63, the second side being a mirror image.
Figure 65:
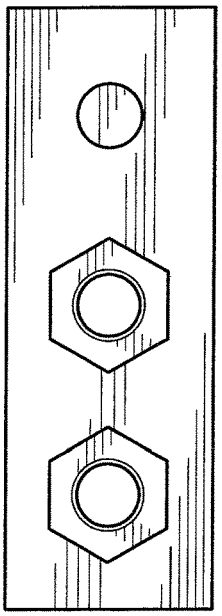
FIG. 65 is a rear view of the fixing plate of FIG. 63.
Figure 66:
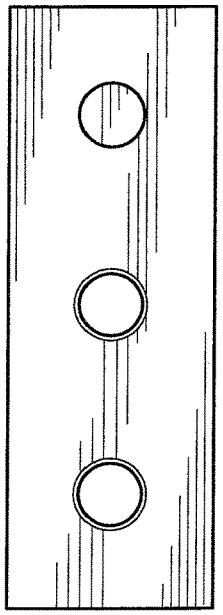
FIG. 66 is a front view of the fixing plate of FIG. 63.
Figure 68:
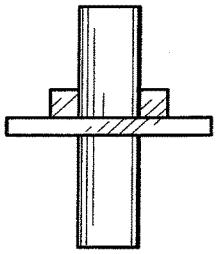
FIG. 68 is a top view of the fixing plate of FIG. 63.
Figure 69:
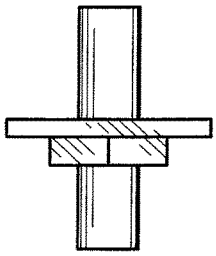
FIG. 69 is a bottom view of the fixing plate of FIG. 63.
Figure 70:
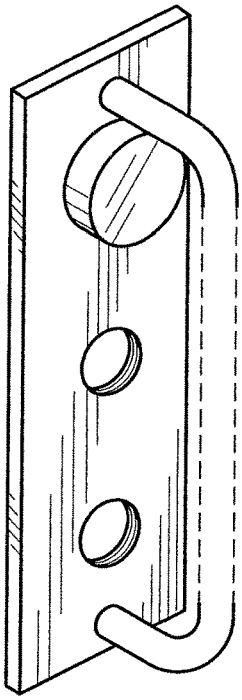
FIG. 70 is a rear perspective view of the sixth fixing plate, of FIG. 12, for a connection between a horizontal shelf support member and a vertical shelf support member.
Figure 71:
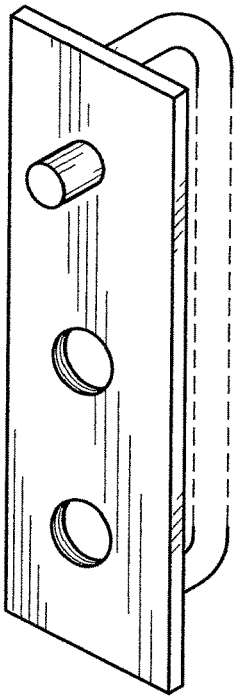
FIG. 71 is a front perspective view of the fixing plate of FIG. 70.
Figure 74:
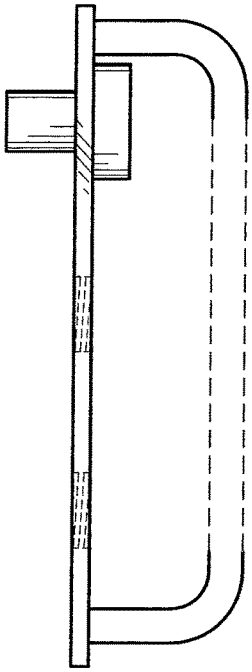
FIG. 74 is a first side view of the fixing plate of FIG. 70, the second side being a mirror image.
Figure 73:
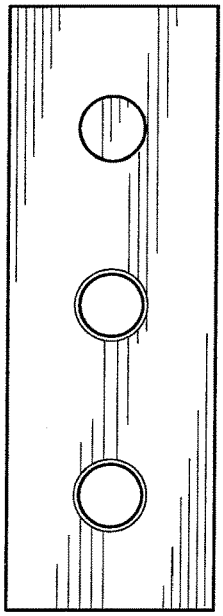
FIG. 73 is a front view of the fixing plate of FIG. 70.
Figure 72:
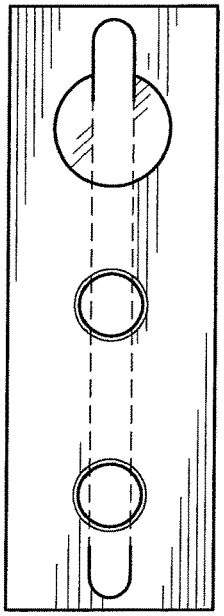
FIG. 72 is a rear view of the fixing plate of FIG. 70.
Figure 75:
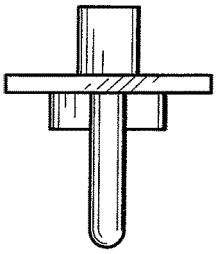
FIG. 75 is a top view of the fixing plate of FIG. 70.
Figure 76:
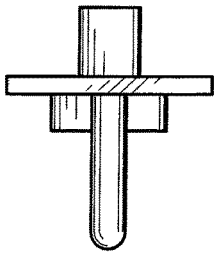
FIG. 76 is a bottom view of the fixing plate of FIG. 70.
Figure 77:
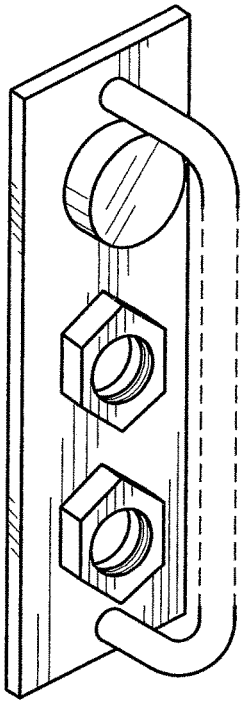
FIG. 77 is a rear perspective view of the seventh fixing plate, of FIG. 13, for a connection between a horizontal shelf support member and a vertical shelf support member.
Figure 78:
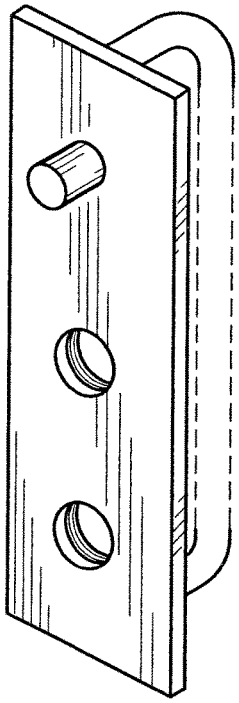
FIG. 78 is a front perspective view of the fixing plate of FIG. 77.
Figure 81:
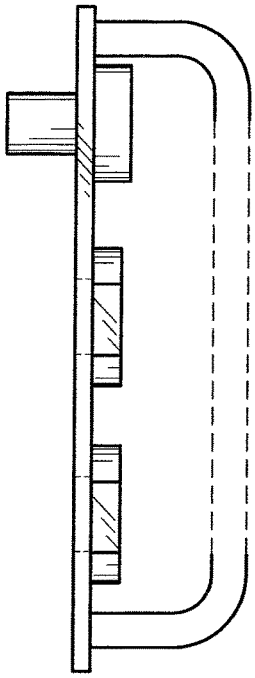
FIG. 81 is a first side view of the fixing plate of FIG. 77, the second side being a mirror image.
Figure 80:
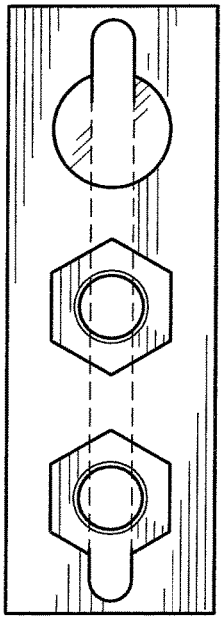
FIG. 80 is a rear view of the fixing plate of FIG. 77.
Figure 79:
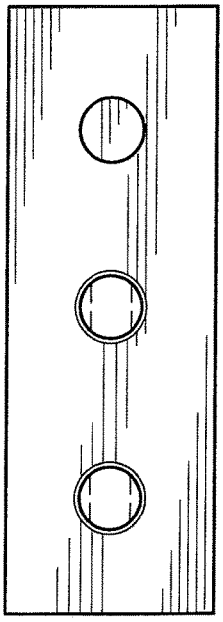
FIG. 79 is a front view of the fixing plate of FIG. 77.
Figure 82:
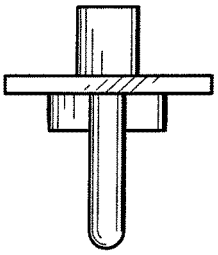
FIG. 82 is a top view of the fixing plate of FIG. 77.
Figure 83:
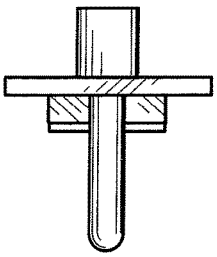
FIG. 83 is a bottom view of the fixing plate of FIG. 77.
Figure 84:
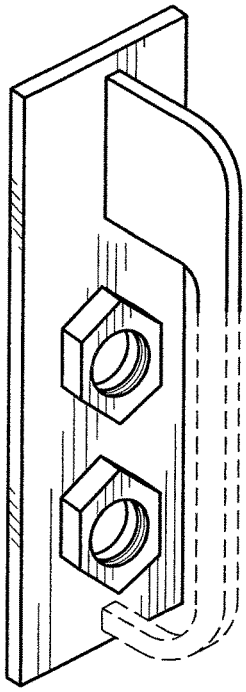
FIG. 84 is a rear perspective view of the ninth fixing plate, of FIG. 15, for a connection between a horizontal shelf support member and a vertical shelf support member.
Figure 85:
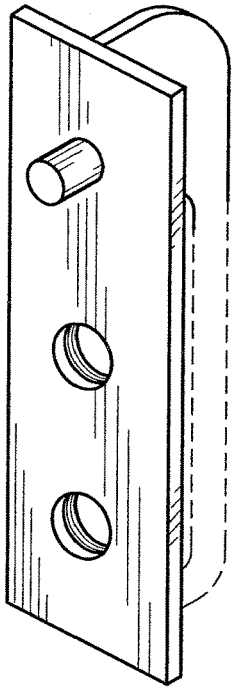
FIG. 85 is a front perspective view of the fixing plate of FIG. 84.
Figure 88:
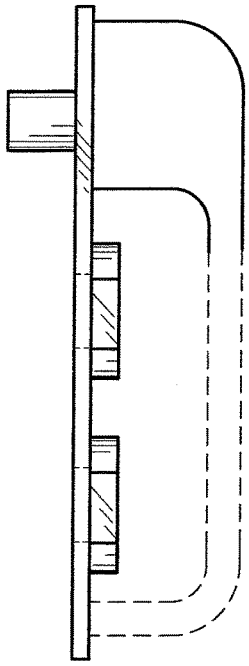
FIG. 88 is a first side view of the fixing plate of FIG. 84, the second side being a mirror image.
Figure 87:
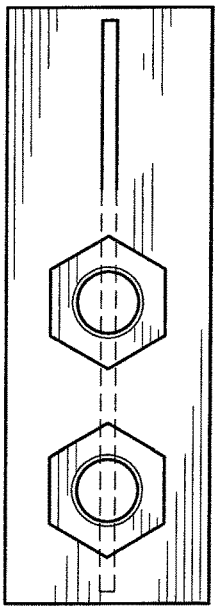
FIG. 87 is a rear view of the fixing plate of FIG. 84.
Figure 86:
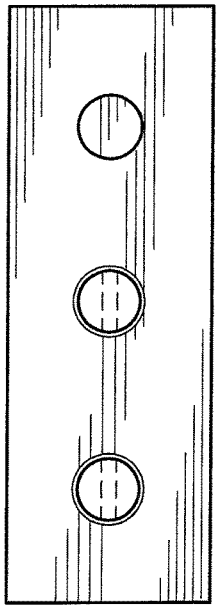
FIG. 86 is a front view of the fixing plate of FIG. 84.
Figure 89:
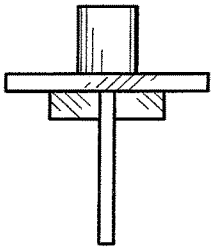
FIG. 89 is a top view of the fixing plate of FIG. 84.
Figure 90:
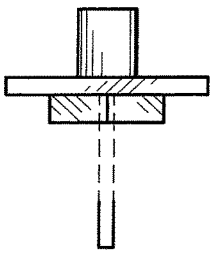
FIG. 90 is a bottom view of the fixing plate of FIG. 84.
Figure 91:
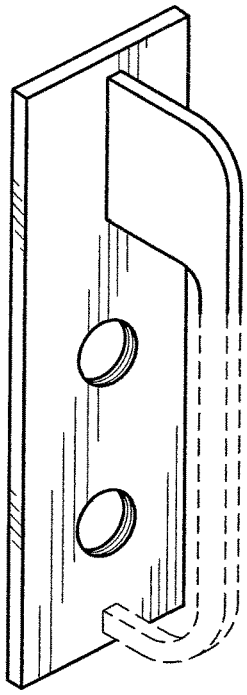
FIG. 91 is a rear perspective view of the eighth fixing plate, of FIG. 14, for a connection between a horizontal shelf support member and a vertical shelf support member.
Figure 92:
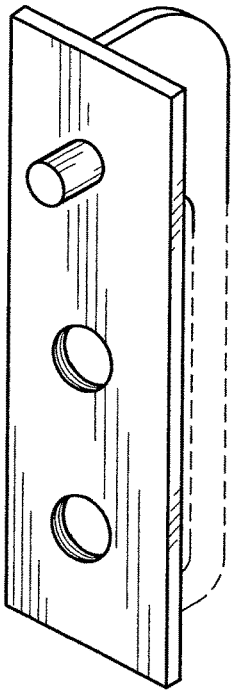
FIG. 92 is a front perspective view of the fixing plate of FIG. 91.
Figure 95:
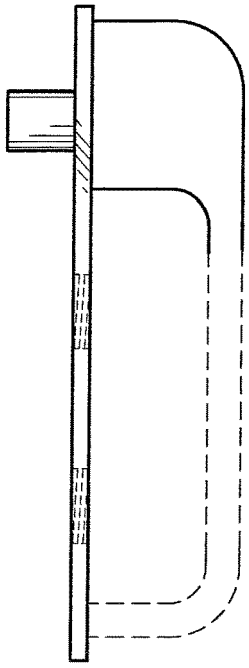
FIG. 95 is a first side view of the fixing plate of FIG. 91, the second side being a mirror image.
Figure 94:
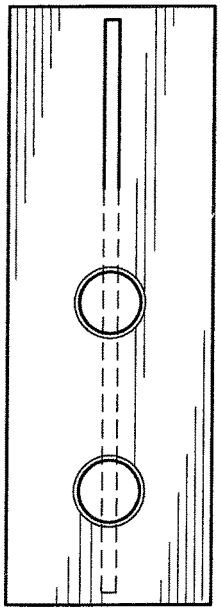
FIG. 94 is a rear view of the fixing plate of FIG. 91.
Figure 93:
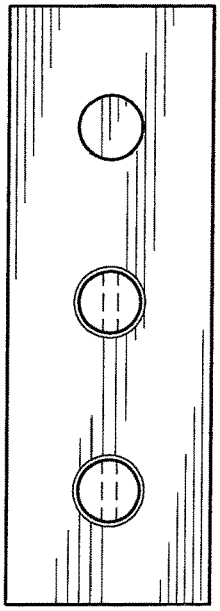
FIG. 93 is a front view of the fixing plate of FIG. 91.
Figure 96:
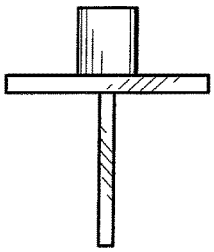
FIG. 96 is a top view of the fixing plate of FIG. 91.
Figure 97:
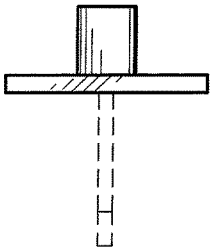
FIG. 97 is a bottom view of the fixing plate of FIG. 91.

FIGS. 9 through 17 show various alternative embodiments of a fixing flange for a shelving unit having different types of handles for handling the fixing flange. These various embodiments are given by way of example only and the invention is not limited to the exact details of construction and the arrangements of elements detailed in these embodiment. The invention is capable of being practiced in other embodiments or carried out in various other ways. The embodiments of FIGS. 9, 10 and 11 have cylindrical projections 33*a* that acts as a handle for handling the fixing plate. The embodiments of FIGS. 12 to 15 have a longitudinal handle 39. In FIGS. 12 and 13 the longitudinal handle 39 is a wire handle. In FIGS. 14 and 15 the longitudinal handle 39 has a plate element 40 to provide an additional grip surface. The embodiments of FIGS. 12 to 15 have a latitudinal handles 414*a* to 41*b*. The latitudinal handles 41 may be wire or plate type handles and there may be one or two such handles spaced apart longitudinal on the fixing flange. In the various embodiments of FIGS. 9, 10, 12, 14 and 16 the fixing points 29*a-b* comprises threaded fixing apertures into which fasteners 27 can threadably engage directly. In the various embodiments of FIGS. 11, 13, 15 and 17 the two fixing points 29*a-b* comprises fixing apertures backed by threaded fixing nuts 30*a-b*. The FIGS. 20 through 97 show various designs of a fixing flange for a shelving unit. The elements shown in broken lines in the figures (FIGs) are included for the purpose of illustrating environment and form no part of the claimed design for the fixing plate.

What is claimed is:

1. A shelving unit comprising:

a horizontal support member, a vertical support member, a fastener for securing the horizontal support member to the vertical support member, wherein the horizontal support member is securable to the vertical support member at any one of a plurality of vertical locations along the vertical support member, the vertical support member has, in a cross-section transverse to the vertical support member, a C-shape, with a front face and two side faces that are transverse to the front face, extending from respective edges of the front face of the vertical support member, the vertical support member has a linear array of uniformly spaced apart apertures at the vertical locations in the front face of the vertical support member, proximate each of the edges of the vertical support member, and the horizontal support member has a support flange with a linear array of flange apertures, and a backing plate having a linear array of uniformly spaced apart fixing points, wherein the backing plate includes a plate member including the linear array of fixing points and a flange extending from and transverse to the plate member, at least one of the fixing points includes a projection for occupying a corresponding one of the apertures and a corresponding one of the flange apertures, and at least one of the fixing points has a threaded fixing aperture, and a threaded fastener threadedly securable to the backing plate in the threaded fixing aperture, while occupying the corresponding one of the apertures and the corresponding one of the flange apertures, with the front face of the vertical support member disposed between the support flange of the horizontal support member and the plate member of the backing plate.

2. The shelving unit of claim 1, including two threaded fasteners, wherein the vertical support member has at least three uniformly spaced apart apertures at the vertical locations, the support flange has two uniformly spaced apart spaced support apertures, the backing plate has at least three uniformly spaced apart fixing points and at least two of the fixing points are uniformly spaced apart threaded fixing apertures and the two threaded fasteners are threadedly securable to the threaded fixing apertures, while occupying two of the flange apertures and two of the apertures, with the projection occupying another of the apertures.

3. The shelving unit of claim 1, wherein the projection remains in one of the apertures during fixing of the horizontal and vertical support members to each other with the threaded fastener.

4. The shelving unit of claim 1, wherein the flange of the backing plate extends from a side of the plate member and the linear array of fixing points extends parallel to the side of the plate member.

5. The shelving unit of claim 1, wherein the flange of the backing plate extends from a top of the plate member and the linear array of fixing points extends transverse to the top of the plate member.

6. The shelving unit of claim 1, wherein the fixing point including the threaded fixing aperture comprises a threaded hole in the plate member of the backing plate.

7. The shelving unit of claim 1, wherein the fixing point including threaded fixing aperture comprises a hole in the plate member of the backing plate and a threaded fixing nut attached to the plate member of the backing plate and aligned with the hole.

8. A shelving unit comprising:

a vertical support member having a linear vertical array of a plurality of uniformly spaced apart apertures, wherein adjacent apertures are spaced apart by an interval, the vertical support member has, in a cross-section transverse to the vertical support member, a C-shape, with a front face and two side faces that are transverse to the front face, extending from respective edges of the front face of the vertical support member, and the linear vertical array of uniformly spaced apart apertures are located in the front face of the vertical support member, proximate each of the edges of the vertical support member;

a horizontal support member having a support flange with a pair of flange apertures separated by the interval and alignable with respective pairs of the apertures in the vertical support member;

a backing plate having a linear array of first, second, and third uniformly spaced apart fixing points, wherein the backing plate includes a plate member including the first, second, and third fixing points and a flange extending from and transverse to the plate member, the fixing points are spaced apart by the interval, the first fixing point is a projection projecting outward from the plate member of the backing plate for occupying a corresponding aperture of the vertical support member, and the second and third fixing points are fixing apertures in the plate member of the backing plate; and a threaded fastener passing through an aperture of the vertical support member and a flange aperture of the flange of the horizontal support member that is aligned with the aperture of the vertical support member and threadedly engaging one of the fixing apertures of the plate member of the backing plate for securing the horizontal support member to the vertical support member, with the front face of the vertical support member sandwiched between the flange of the horizontal support member and the plate member of the backing plate.

9. The shelving unit of claim 8, wherein at least one of the second and third fixing points of the plate member of the backing plate is a fixing aperture including threads for threadedly engaging the fastener.

10. The shelving unit of claim 8, wherein at least one of the second and third fixing points of the backing plate is a threaded fixing nut attached to the plate member of the backing plate and aligned with one of the second and third fixing points for threadedly engaging the fastener.

11. The shelving unit of claim 10, further including a handle attached to the plate member of the backing plate, and extending in a direction opposite from the projection.

12. The shelving unit of claim 11, wherein the handle and the fixing nut are commonly attached to a back face of the plate member of the fixing plate.

13. The shelving unit of claim 8, wherein the flange of the backing plate extends from a side of the plate member and the first, second, and third fixing points extend along a line parallel to the side of the plate member.

14. The shelving unit of claim 8, wherein the flange of the backing plate extends from a top of the plate member and the first, second, and third fixing points extend along a line transverse to the top of the plate member.

* * * * *